US008387785B2

(12) United States Patent
Weissich

(10) Patent No.: US 8,387,785 B2
(45) Date of Patent: Mar. 5, 2013

(54) TWO CHAMBERED BABY BOTTLE ATTACHMENT FOR STORING AND DISPENSING INFANT FORMULA

(76) Inventor: Seth Kershaw Weissich, Loxley, AL (US)

( * ) Notice: Subject to any disclaimer, the term of this patent is extended or adjusted under 35 U.S.C. 154(b) by 622 days.

(21) Appl. No.: 12/586,457

(22) Filed: Sep. 23, 2009

(65) Prior Publication Data

US 2011/0068080 A1 Mar. 24, 2011

(51) Int. Cl.
*B65D 25/08* (2006.01)

(52) U.S. Cl. ..... 206/219; 220/501; 220/521; 215/6; 215/DIG. 8

(58) Field of Classification Search ..... 206/219, 206/217; 215/387, 6, 11.1, DIG. 8; 220/521, 220/502, 501

See application file for complete search history.

(56) References Cited

U.S. PATENT DOCUMENTS

2007/0119727 A1* 5/2007 Cho ..... 206/219

* cited by examiner

*Primary Examiner* — Stephen Castellano

(57) ABSTRACT

An infant formula storage and dispensing assembly that attaches to a baby bottle. The assembly is made up of two parts. The top half having external threads to accept a baby bottle ring with nipple and including slots that form a chamber to store infant formula to be mixed with water stored in the baby bottle. The bottom half having internal threads allowing it to be screwed onto a baby bottle including also slots that align with the top half and allow above mentioned sealing or dispensing action. The two halves fit together by the bottom half sliding into the top half and being attached by a center located bolt and nut.

1 Claim, 4 Drawing Sheets

TWO CHAMBERED BABY BOTTLE ATTACHMENT FOR STORING AND DISPENSING INFANT FORMULA

FEDERALLY SPONSORED RESEARCH OR DEVELOPMENT

Not applicable

SEQUENCE LISTING

Not applicable

BACKGROUND OF THE INVENTION

This invention relates to storing and dispensing pre-measured quantities of infant's formula in conjunction with a baby bottle.

BRIEF SUMMARY OF THE INVENTION

The purpose of this invention is to provide the user an easy method to mix powdered infant formula in a baby bottle. The invention attaches to any standard size baby bottle. The invention stores the powdered infant formula until the user wishes to mix with water stored separately in a baby bottle. The user twists the two parts of the invention to allow the powdered infant formula to drop into the bottle and mix with the water combining to make the formula.

DETAILED DESCRIPTION OF THE INVENTION

Figure 1:
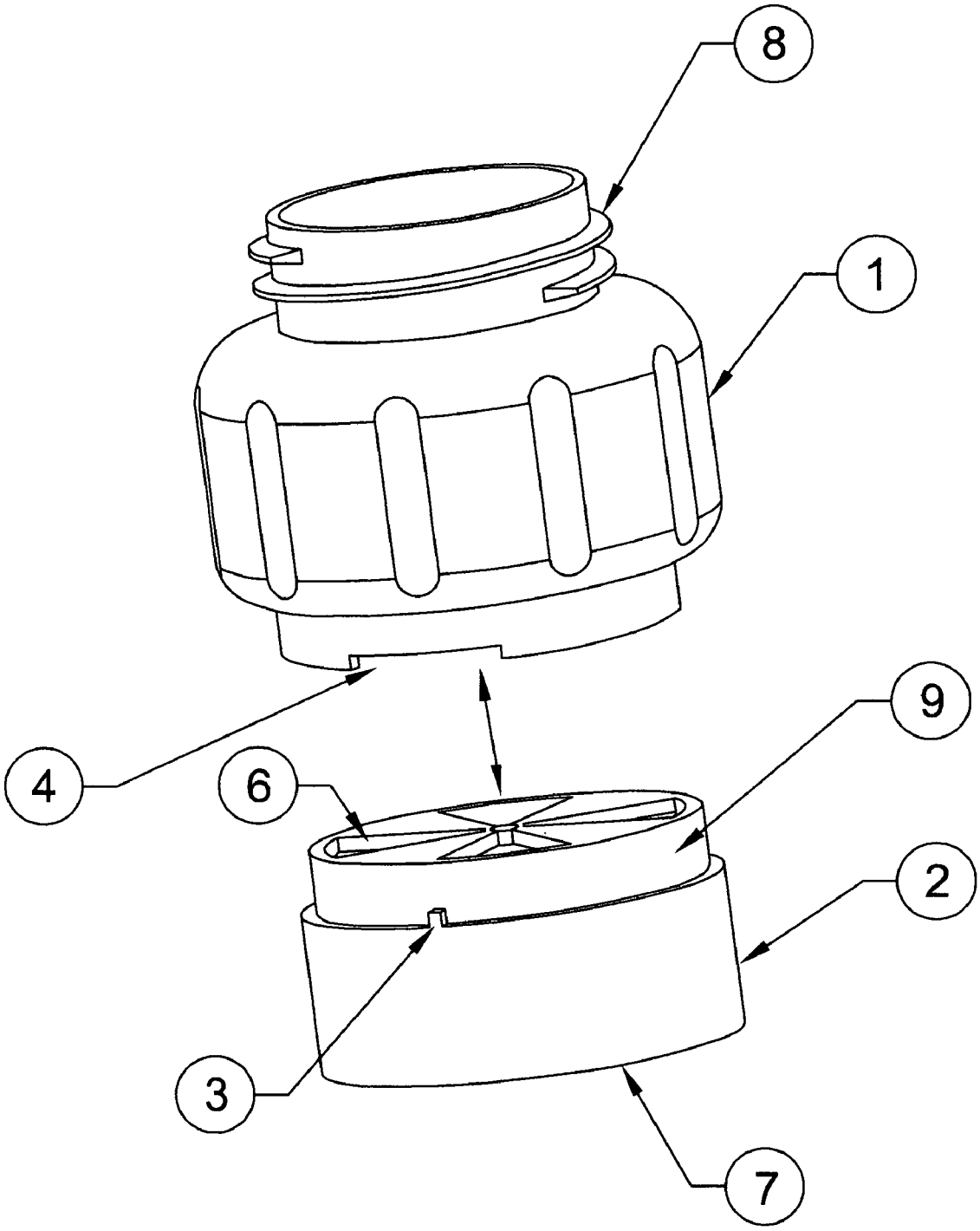
FIG. 1 is an exploded perspective view of the invention showing the two parts that make the invention up.

Referring to FIG. 1 there is shown a device to store and dispense infant formula. It is made from two parts. A top half represented by reference numeral 1, and a bottom half represented by reference numeral 2.

The recessed area 9 of the bottom half 2 slides into the bottom part of the top half 1. The tab 3 on the bottom half 2 aligns with the slot 4 on the top half 1. The top and bottom halves are joined with a nut and bolt (not shown) inserted through a hole 5 (FIG. 2) in both the upper and lower halves.

The invention attaches to the tip of a standard baby bottle by screwing threads 7 (FIG. 4) onto threads of the baby bottle. The ring and nipple from the baby bottle attaches to the threads 8 (FIG. 1) thus sealing the chamber in which infant formula can be stored.

Figure 2:
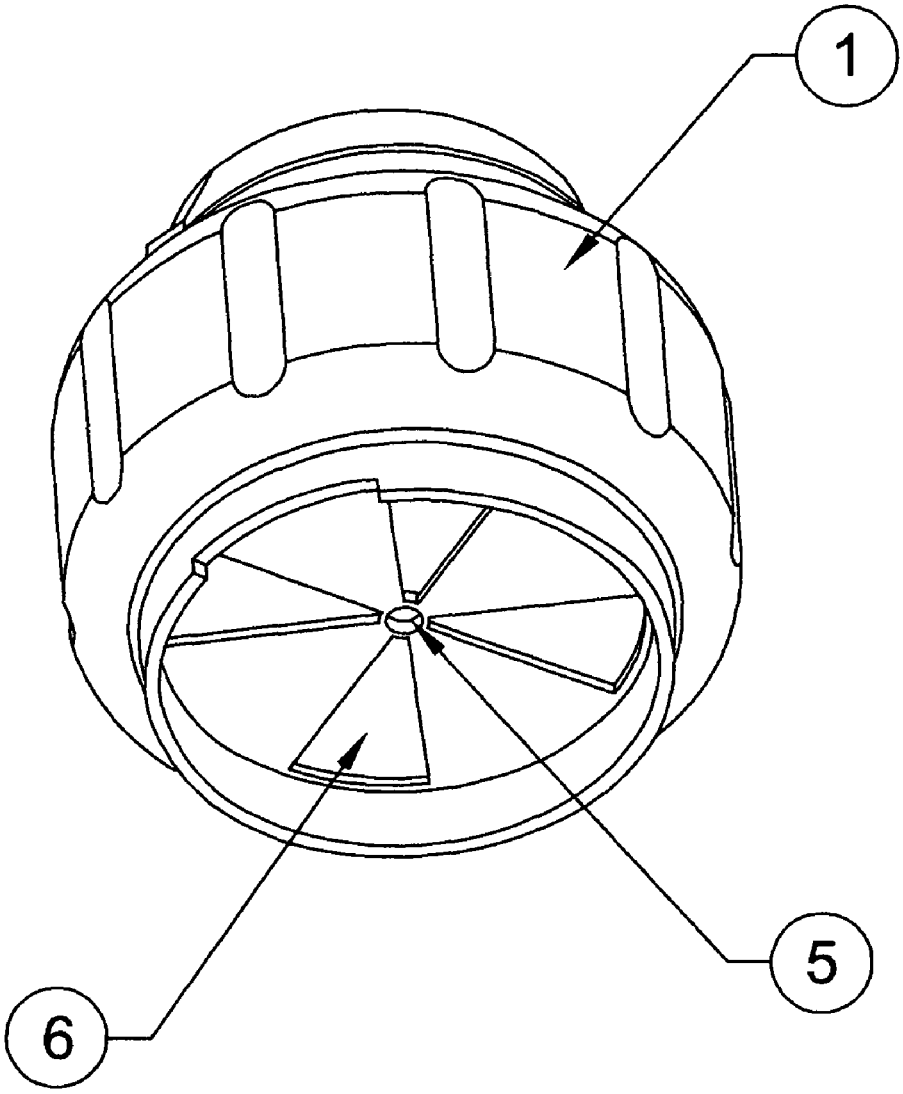
FIG. 2 shows the bottom side of the upper half of the invention and details specific features of the invention.
Figure 3:
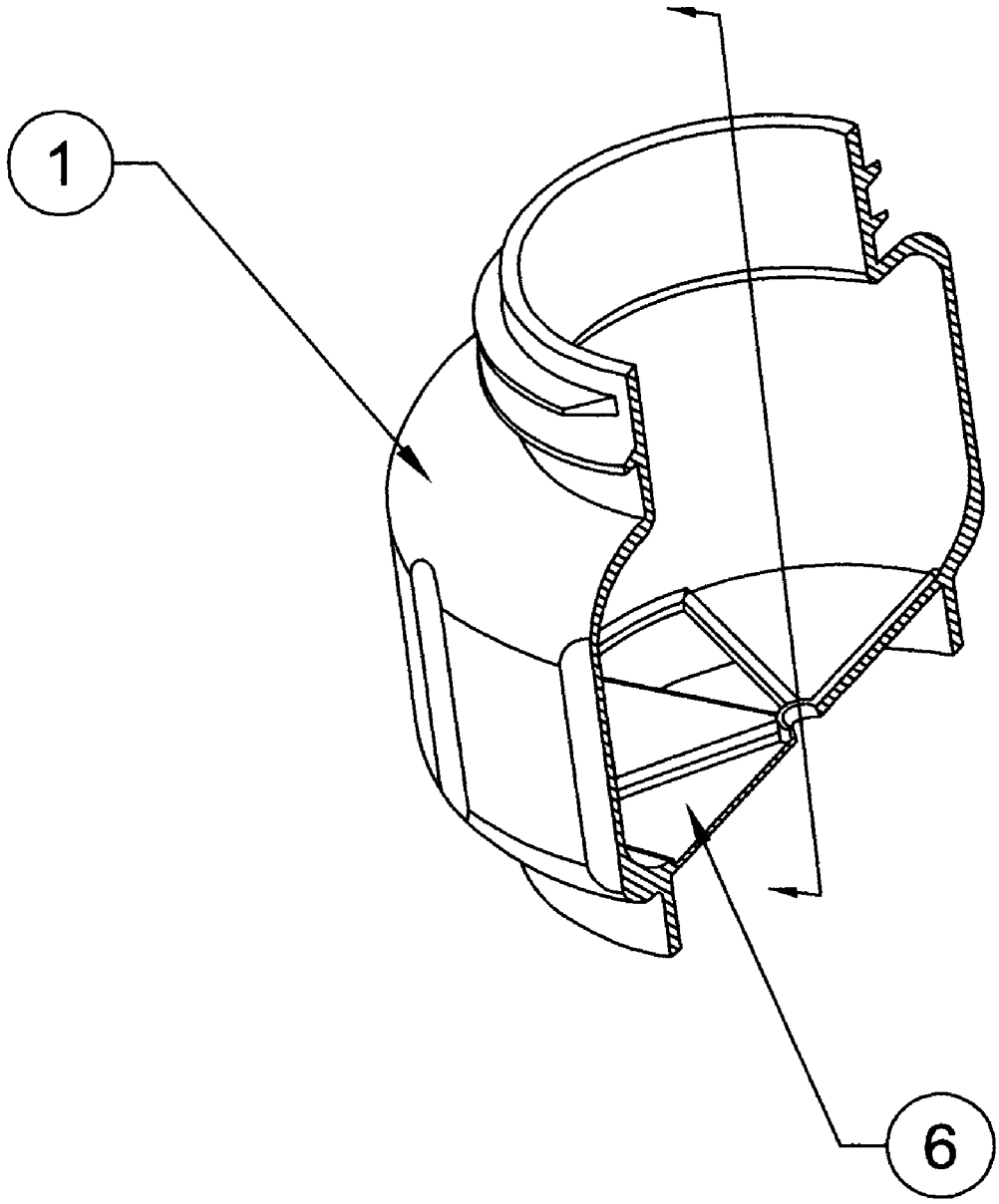
FIG. 3 shows a section view of the upper half of the invention.

Referring to FIGS. 2 and 3 there is shown the underside of (FIG. 2) the top half 1 (FIG. 1). FIG. 3 shows a sectional view of the top half 1 (FIG. 1). When the top half 1 (FIG. 1) and bottom half 2 (FIG. 1) are joined the openings 6 and 10 (FIG. 4) are aligned when the invention is in an "open" state. Furthermore the tab 3 (FIG. 1) is oriented to the far right side of the slot 4 (FIG. 1) when the invention is in an "open" state.

To close the invention and form a chamber within the top half 1 (FIG. 1) the openings 6 and openings 10 (FIG. 4) must be misaligned thus forming a separation between the lower half 2 (FIG. 1) and the chamber within the upper half 1 (FIG. 1). The tab 3 (FIG. 1) will be oriented to the far left side of the slot 4 (FIG. 1) when the invention is in a "closed" state.

Figure 4:
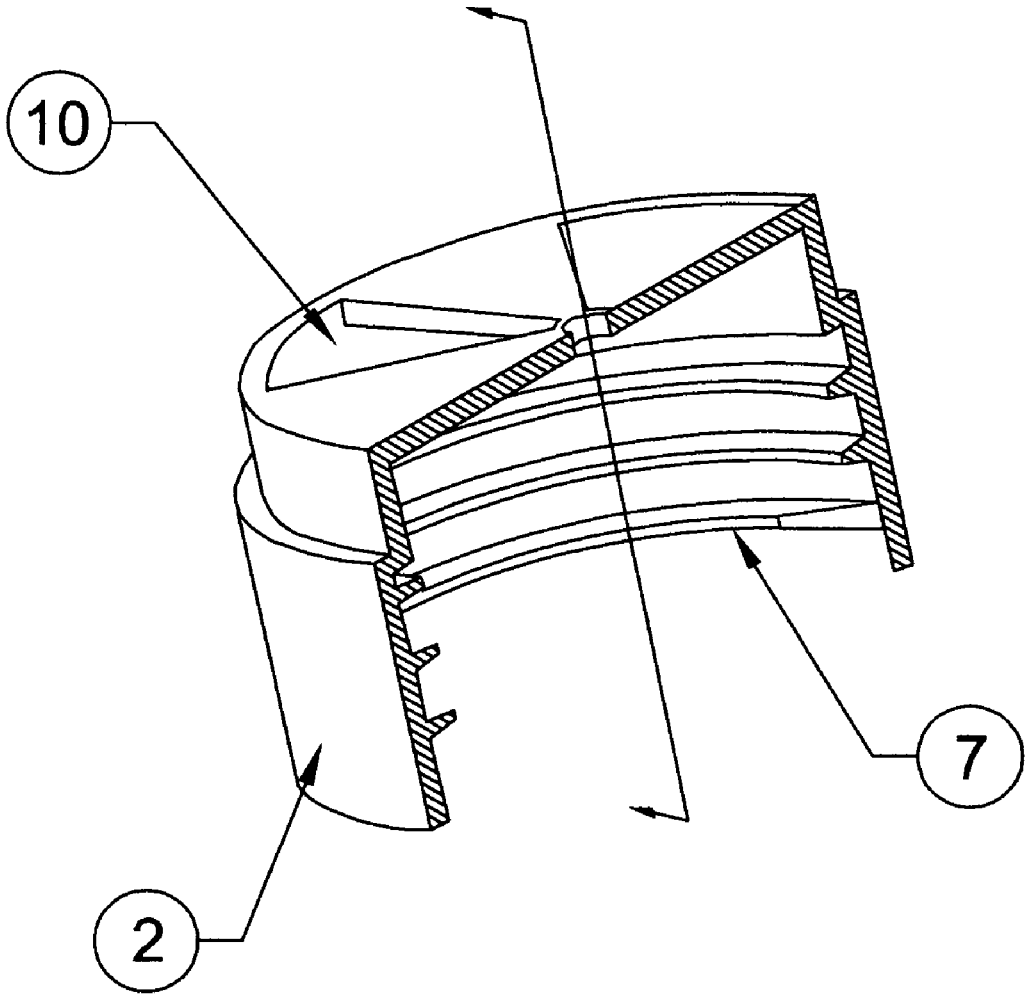
FIG. 4 shows a section view of the lower half of the invention.

Referring to FIG. 4 there is shown a sectional view of the bottom half 2 (FIG. 1).

I claim:

1. A two-part infant formula storage and dispensing device for attachment to a baby bottle, the device comprising, a top half having a top cylindrical housing defining a chamber for storing a substance, said housing having an opening at each of it's top and bottom ends, the top end being completely open and having external threads, and the bottom end being partially open having triangular slots extending from the center outward in an alternating pattern leaving solid spaces between each slot; and a bottom half having a bottom cylindrical housing for attachment of the device to a baby bottle, said bottom housing having an opening at each of it's top and bottom ends, the top end of said bottom housing having a slightly smaller diameter than the bottom end of said top housing to allow fitment of an upper portion of said bottom housing into said top housing, the top end of said bottom housing being partially open having triangular slots extending from the center outward in an alternating pattern leaving solid spaces between each slot, the bottom end of said bottom housing being completely open and having internal threads to enable the device to be attached to a baby bottle using said internal threads;

said top and bottom halves are secured together by a nut and bolt connection which extends through holes in each of said top and bottom housings, the holes are aligned along a central vertical axes of each housing allowing said top housing to rotate with respect to said bottom housing;

said top housing having a downwardly depending skirt receiving said upper portion of said bottom housing therein, said top housing has a notch in the lower edge of the skirt which receives a tab extending radially outwardly from said upper portion of said bottom housing, when the tab is oriented to the far right side of the slot, the triangular slots of said top and bottom housings align to open the chamber for dispensing and when the tab is oriented to the far left side of the slot, the triangular slots of said top and bottom housings misalign to close the chamber for storage;

said top housing having a larger outer diameter than said bottom housing, said top housing having vertically extending grooves on its exterior surface.

* * * * *